US007562950B2

(12) United States Patent
Lam et al.

(10) Patent No.: US 7,562,950 B2
(45) Date of Patent: Jul. 21, 2009

(54) DRAWER STABILIZING ARRANGEMENT FOR DOUBLE WALLED DRAWER

(75) Inventors: Harn Lian Lam, Ipoh (MY); Harn Yan Lam, Ipoh (MY)

(73) Assignee: Harn Marketing SDN BHD, Ipoh, Perak (MY)

( * ) Notice: Subject to any disclaimer, the term of this patent is extended or adjusted under 35 U.S.C. 154(b) by 450 days.

(21) Appl. No.: 10/552,215

(22) PCT Filed: May 21, 2004

(86) PCT No.: PCT/SG2004/000148

§ 371 (c)(1),
(2), (4) Date: Oct. 6, 2005

(87) PCT Pub. No.: WO2004/103119

PCT Pub. Date: Dec. 2, 2004

(65) Prior Publication Data

US 2006/0214548 A1 Sep. 28, 2006

(30) Foreign Application Priority Data

May 22, 2003 (MY) ..... PI 2003 1897

(51) Int. Cl.
*A47B 88/00* (2006.01)

(52) U.S. Cl. ..... 312/332; 312/330.1

(58) Field of Classification Search ..... 312/330.1, 312/333, 334.1, 334.4, 334.5, 334.6, 348.1, 312/348.2, 332; 384/22, 21
See application file for complete search history.

(56) References Cited

U.S. PATENT DOCUMENTS

| | | | | |
|---|---|---|---|---|
| 4,810,045 | A | 3/1989 | Lautenschlager | |
| 4,961,614 | A | 10/1990 | Rock | |
| 4,983,000 | A * | 1/1991 | Rock | 312/333 |
| 5,039,181 | A * | 8/1991 | Lautenschlager | 312/334.7 |
| 5,281,021 | A * | 1/1994 | Rock et al. | 312/334.32 |
| 5,306,080 | A * | 4/1994 | Lautenschlager et al. | 312/334.5 |
| 5,664,857 | A * | 9/1997 | Lautenschlager et al. | 312/348.4 |
| 5,779,333 | A * | 7/1998 | Lautenschlager | 312/334.15 |
| 2001/0019235 | A1 * | 9/2001 | Hammerle | 312/334.4 |
| 2003/0205955 | A1 * | 11/2003 | Egger | 312/334.5 |
| 2004/0080246 | A1 * | 4/2004 | Michaels | 312/334.5 |

FOREIGN PATENT DOCUMENTS

DE 4114708 A1 11/1992

* cited by examiner

*Primary Examiner*—James O Hansen
(74) *Attorney, Agent, or Firm*—Volpe and Koenig, P.C.

(57) ABSTRACT

An arrangement for stabilizing the in and out movement of a double walled drawer with a guidance during its movement. Runner systems (110*a*) are fixed on both sides of the drawer, to precisely control the movement of the drawer as well as supporting it. The stabilizing assembly is mounted on the support bracket (60) of the drawer, specially configured to provide a stabilizing effect.

11 Claims, 13 Drawing Sheets

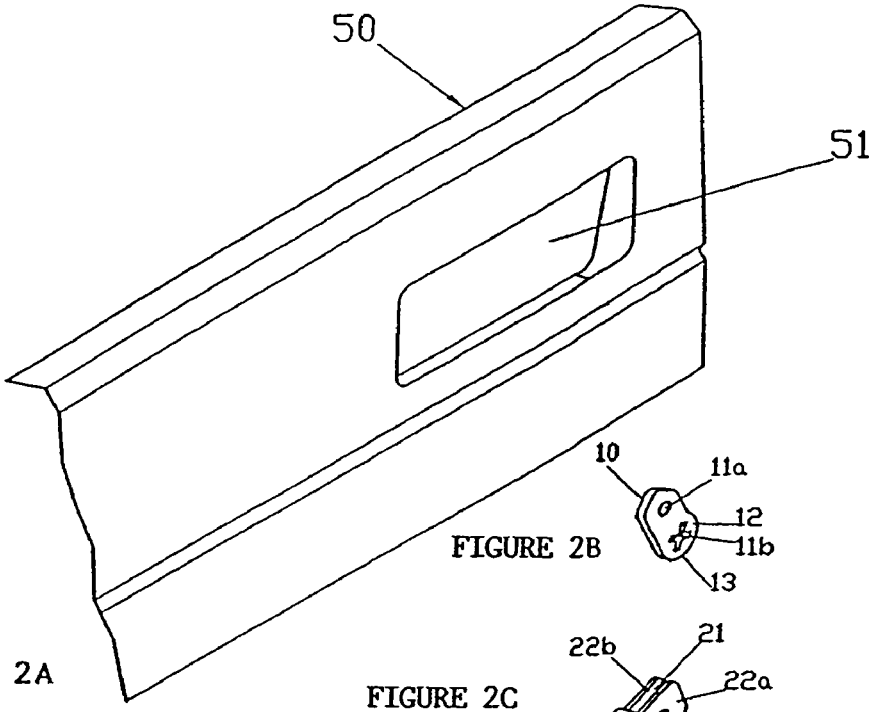
FIGURE 2A
FIGURE 2B
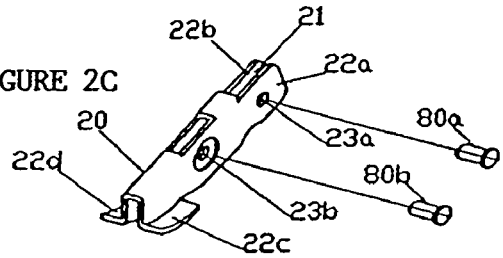
FIGURE 2C
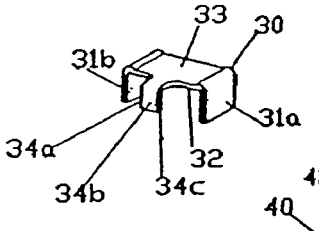
FIGURE 2D
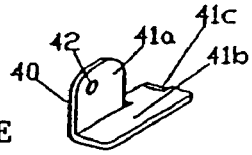
FIGURE 2E
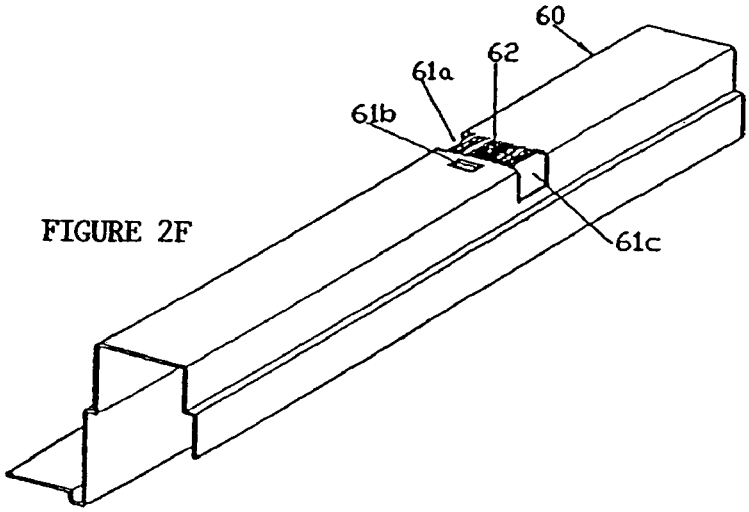
FIGURE 2F

DRAWER STABILIZING ARRANGEMENT FOR DOUBLE WALLED DRAWER

FIELD OF INVENTION

The present invention relates to a drawer stabilizing arrangement, more particular one that substantially prevents the skewing or shifts in orientation as the drawer is opened or closed.

BACKGROUND OF INVENTION

The present invention concerns a drawer stabilizing arrangement, which can be assembled from a plurality of components, including a runner system for controlling the translational movement of the drawer and support means to support the drawer during its in and out movement.

The relative in and out movement of a conventional drawer is generally guided or controlled by guiding means or in other words, drawer guides. Such lateral guides may limit the degree of skew or tilt, due to heavy load or sideward pulling forces of the drawer components. However, such lateral guidance surfaces must provide some clearance in order to provide free movement, and accordingly some looseness may be perceived in the opening and closing of the drawer.

Lateral drawer stabilizers out in the market provide adequate vertical stability of the drawer only if the drawer is relatively heavy, or in a situation where the drawer is crammed with heavy loads.

According to the known state-of-the-art the components for this type of stabilizing arrangement represents a considerable outlay in terms of manufacturing costs and is particularly intended to receive heavy loads.

However, for unloaded light-weight structures, the looseness both laterally and vertically may produce sloppiness in moving the drawer in and out of the supporting furniture member or the like. In addition, the sloppiness will become apparent in large size drawers accommodating heavy loads.

SUMMARY OF INVENTION

The present invention relates to a stabilizing arrangement for use in a double walled drawer in a furniture body, comprising drawer support means, for supporting said drawer during the in and out movement; a guide located in a slot on the support means to accommodate variance between the furniture body and said drawer width; a runner system housed within said support means to enable said in and out movement; wherein said guide being moveable laterally in order to be aligned with a drawer runner system while fitting into said slot and locked thereto when force is applied to said guide.

Accordingly, it is an object of the present invention to provide a motion stabilizer arrangement for relatively heavy or light drawers, loaded or unloaded, installed relatively on either the rear or front region of at least one side or both sides of the drawer, for in and out movement in a respective furniture member.

It is a further object of the present invention to adjust the variance between the interior region of the furniture member and the width of the drawer, as shown in FIG. 9.

BRIEF DESCRIPTION OF THE DRAWINGS

FIG. 2A is an exploded perspective view of the drawer side wall.

FIGS. 2B to 2F are perspective views of various embodiments or components for the stabilizing arrangement according to the present invention.

Figure 1:
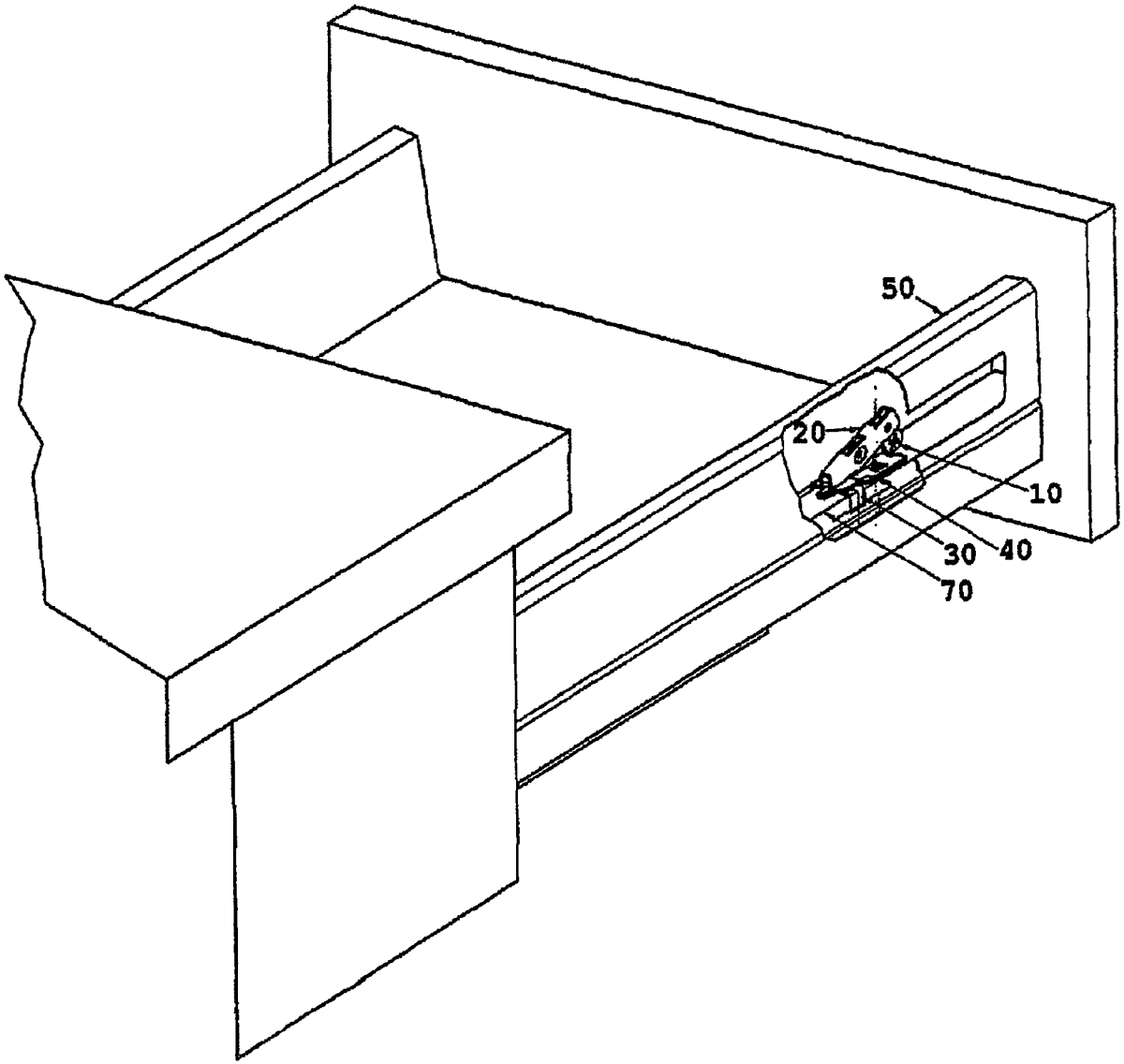
FIG. 1 is a perspective view of a drawer incorporating the stabilizing arrangement in accordance to the present invention.

The invention consists of an arrangement for stabilizing the movement of a drawer when inserted in a furniture body or any supporting structure.

The drawer is stabilized in such a manner as to substantially prevent the drawer from being skewed to one side or horizontally as it is drawn out from the furniture body or shoved back in. Referring to the drawings, FIG. 1 depicts a perspective view of a drawer furnished with the stabilizing arrangement in accordance to the preferred embodiments of the invention, mounted on the top surface of a bottom support bracket of the drawer.

Referring to the drawings, FIG. 1 depicts a perspective view of a drawer furnished with the stabilizing arrangement in accordance to the preferred embodiments of the invention, mounted on the top surface of a bottom support bracket of the drawer.

In this invention, the drawer is preferably of double walled construction. It is fully inserted into a furniture body or any supporting structure, for horizontal in and out movement with respect to the furniture member, in which such movement is guided by a runner system on both sides of the drawer, and is supported by support means such as a bottom support bracket.

The double walled drawer as shown in FIG. 2A, includes an opening/aperture, suitably bordered to receive the stabilization assembled components, in the front region of at least one sidewall of said drawer.

Figure 3:
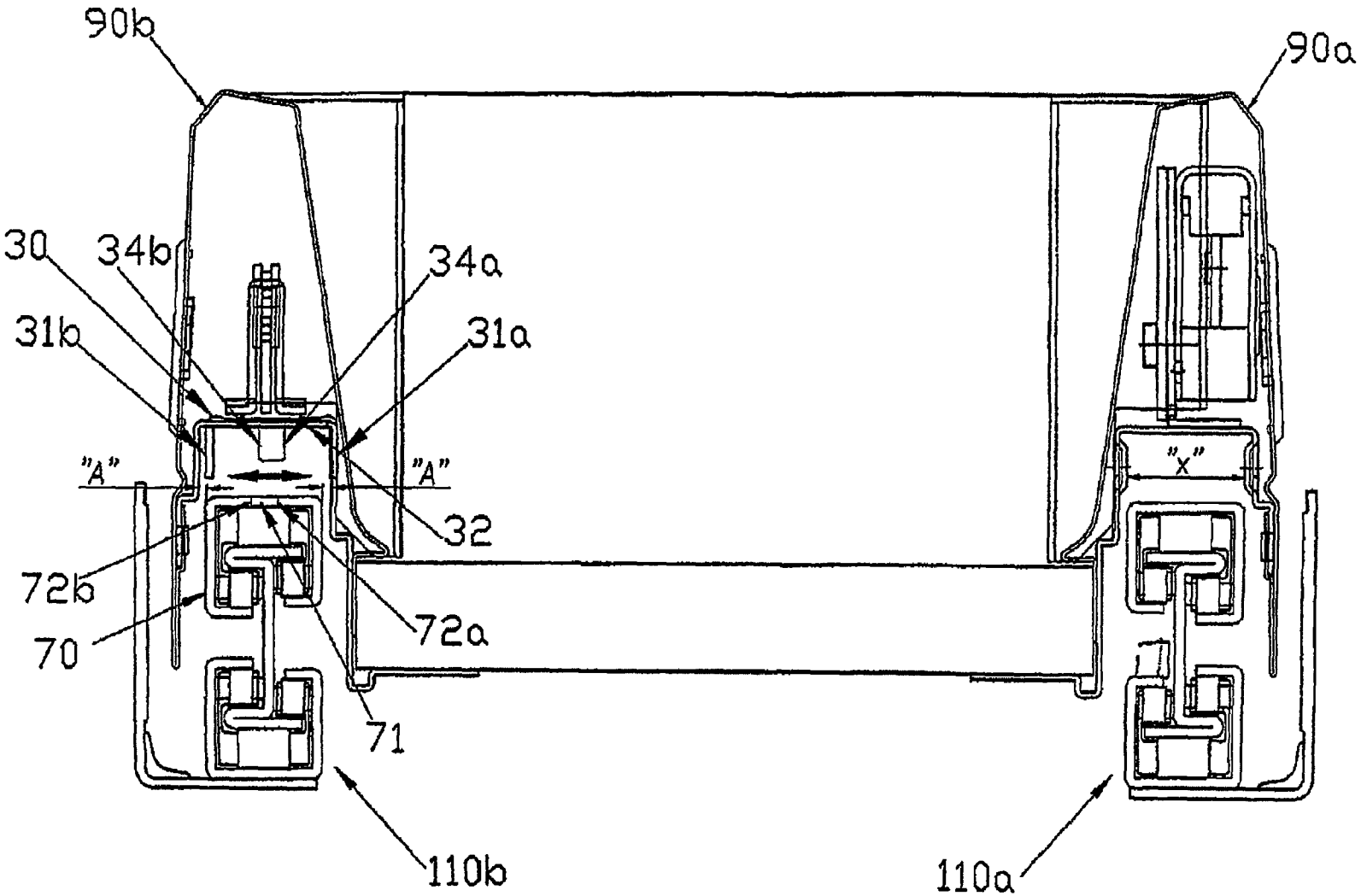
FIG. 3 is the front view of the runner system and the drawer assembly prior to the installation of the stabilizing arrangement according to the present invention.

With reference to FIG. 3, once a conventional drawer is fully inserted into a furniture member, the drawer side 90*a* will be guided by a runner system 110*a* at point "X" and drawer side 90*b* will have a clearance on both sides of the runner system 110*b*, as shown in FIG. 3.

The clearance as depicted in FIG. 3 is the main reason why a drawer is skewed horizontally whenever it is drawn out or even pushed back into a furniture member.

The stabilization assembly in accordance to the present invention is appended on the top surface of a bottom support bracket 60 of said drawer, as shown in FIG. 1.

The present invention comprises a guide 30, a force supplying means, to supply force so as to allow the guide 30 to be in a locked position so as to stabilize the in and out or relative translational movement of the drawer and support means, for supporting the drawer while in relative translational movement.

The essential part of the invention is the guide 30, in which the said guide can be set up with numerous force supplying means, however to achieve the similar effect. Examples are depicted in FIGS. 7A to 7C. The guide 30 can be engaged to the outer surface of the bottom support bracket by a free weight, for example. The weight exerts a force, to ensure maximum contact between the guide and the bottom support bracket, so as to maintain stabilization of the drawer when it is pulled out or pushed back into the respective furniture member.

Various embodiments of the arrangement according to the invention are described below with reference to the accompanying drawings.

In accordance with an exemplary embodiment as shown in FIG. 2C the lever 20 is an inverted U-shape bracket, having at least two through holes 23*a*, 23*b* which are sized to receive the rivets or fastening means, 80*a*, 80*b* and is provided with outwardly stepped planar side extensions positioned at one end of said bracket, which are used to urge down the guide 30, when the arrangement assembly is in motion as depicted in FIG. 2C. Another end of said bracket is formed with a recess to receive the leg 10 slidably fit therein with a through hole 23*a* for fitting in a rivet or fastening means so as to attach the leg 10 pivotally.

According to another embodiment of the present invention, the leg 10 as shown in FIG. 2B is formed preferably from a sheet metal or any suitable material with two side surfaces with a relatively smooth edge, which is adapted to fit a recess 21 of the lever 20. On at least one end region of said leg 10 is a hole 11*a* which corresponds with the hole 23*a* of the lever 20 for fitting in rivets or fastening means in order to attach the leg 10 to the lever 20. On the other end of the leg 10 is a punched screw driver slot 11*b*.

Figure 1A:
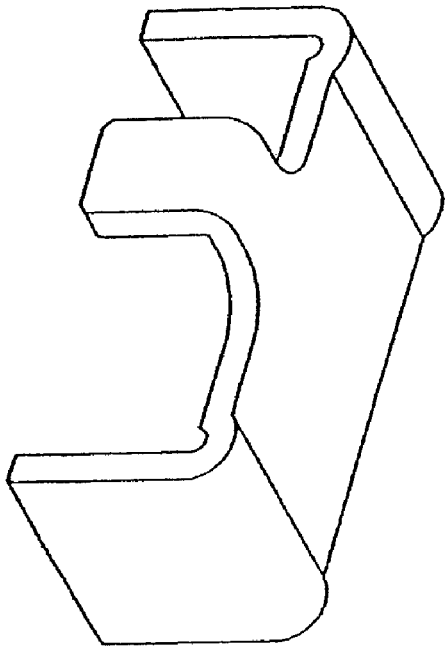
FIG. 1A is the perspective view of the guide in accordance with the present invention.
Figure 1A:
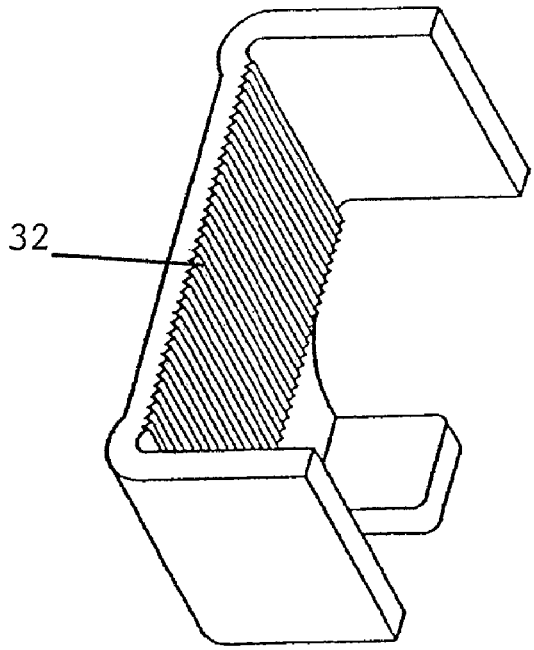

The guide 30 as shown in an enlarged view in FIG. 1A and FIG. 2D, is in the form of a bracket provided with a recess, which is configured to be engaged on the top surface of the bottom support bracket 60 of said drawer. At least on one side of the bracket is formed an L-shape extension which is adapted to fit in slot 61*b* of the bottom support bracket 60.

The guide 30 preferably is sized to fit in a cut-away portion or a slot provided on the bottom support bracket 60, however is able to move laterally within the slot, in order to accommodate the variance between the interior region of the furniture body and the drawer width.

In the embodiment according to FIG. 2F, the bottom support bracket 60 is formed preferably from a sheet metal or any other suitable material into a substantially L-section having a top surface. The top surface is an inverted U shaped and extends in a direction diametric to the L-section, provided with recesses, 61*a*, 61*c*, a slot 61*b* and serration 62 which are configured to receive the guide 30.

With reference to FIG. 2E, a holder 40 is an L-shaped bracket provided with a through fastening hole 42 on the vertical plate 41*a*. The vertical plate 41*a* is insertable in a slot provided on lever 20. The horizontal plate 41*b* of the holder 40 is formed with a chamfered edge 41*c* on one end.

Figure 2G:
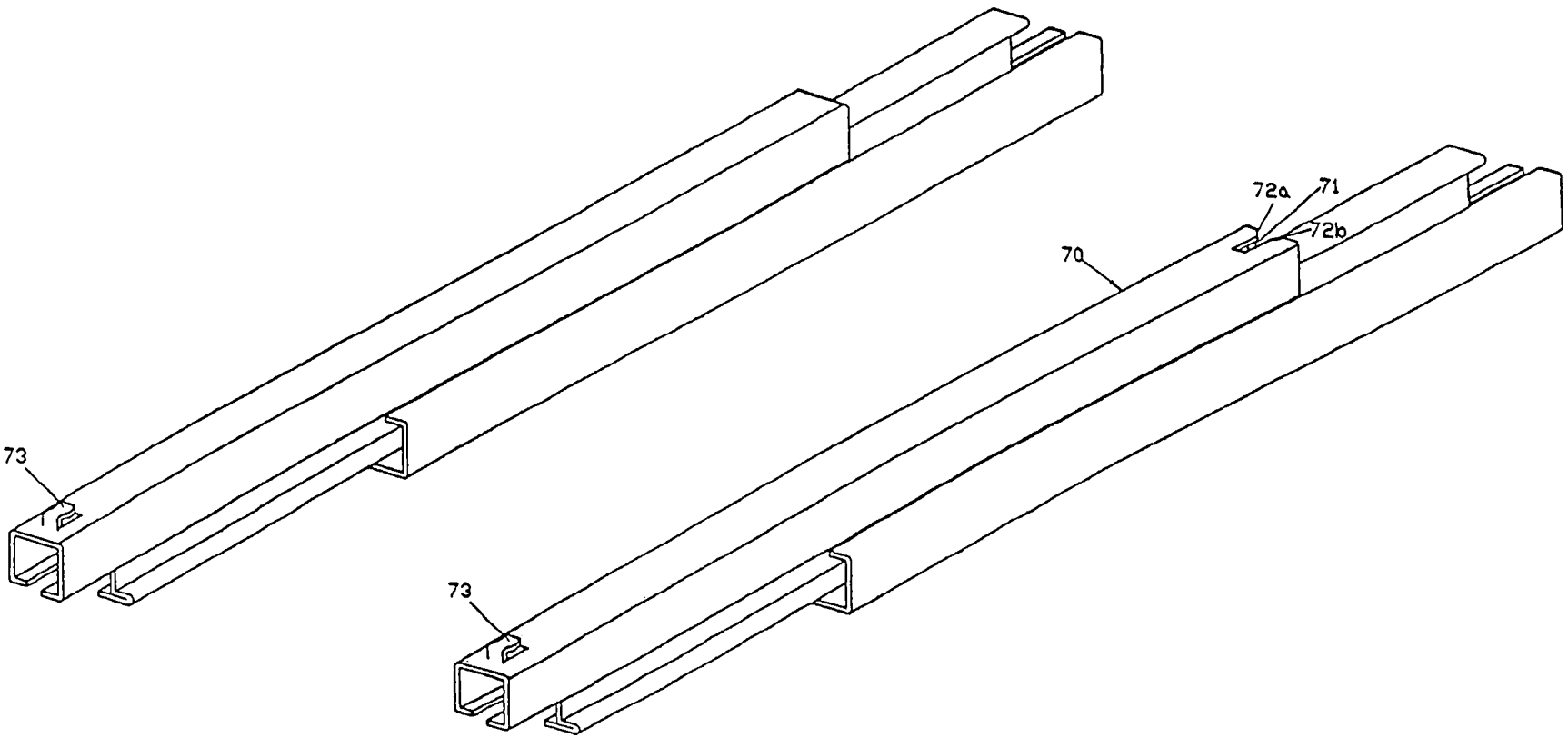
FIG. 2G is a perspective view of the runner system of the drawer.
Figure 4A:
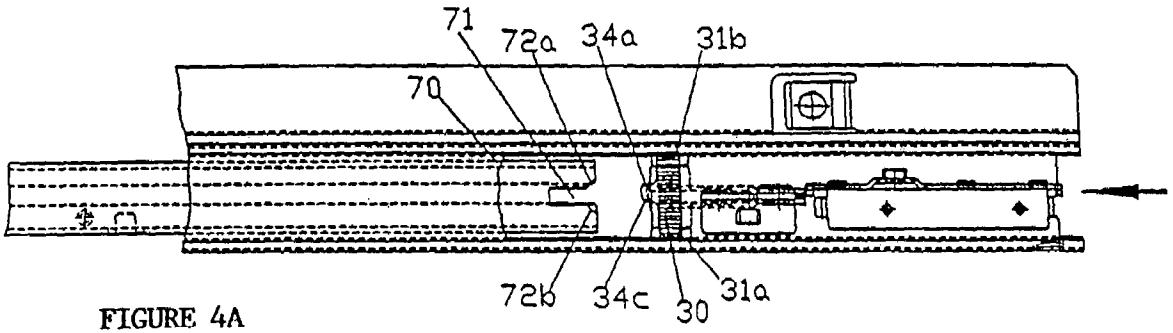
FIGS. 4A to 4C are the top views in partial section of the engagement between the top channel of the runner system and the guide, according to the present invention.
Figure 4B:
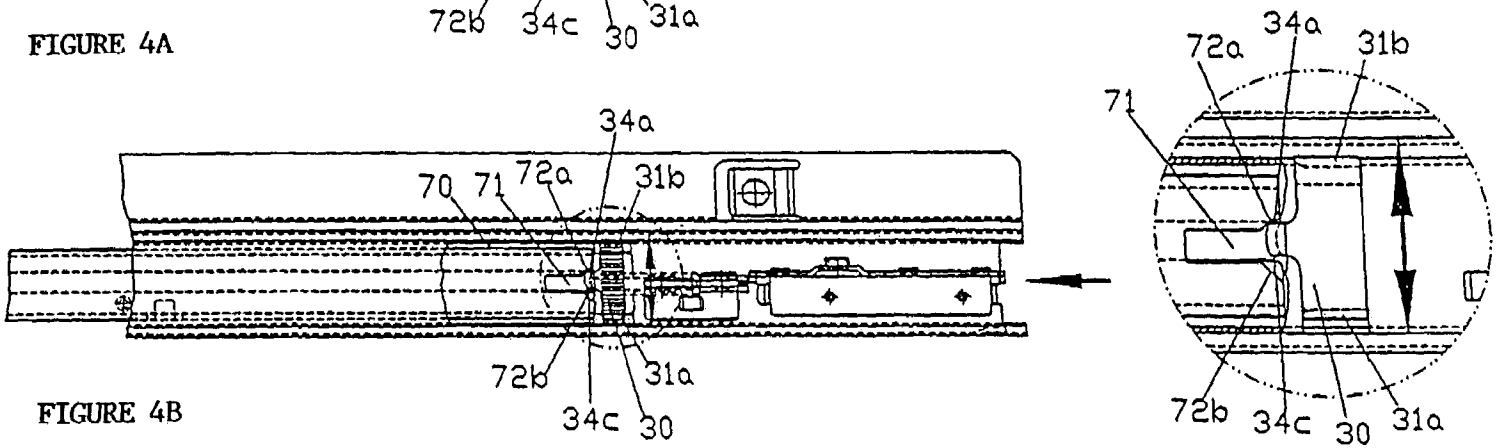
Figure 4C:
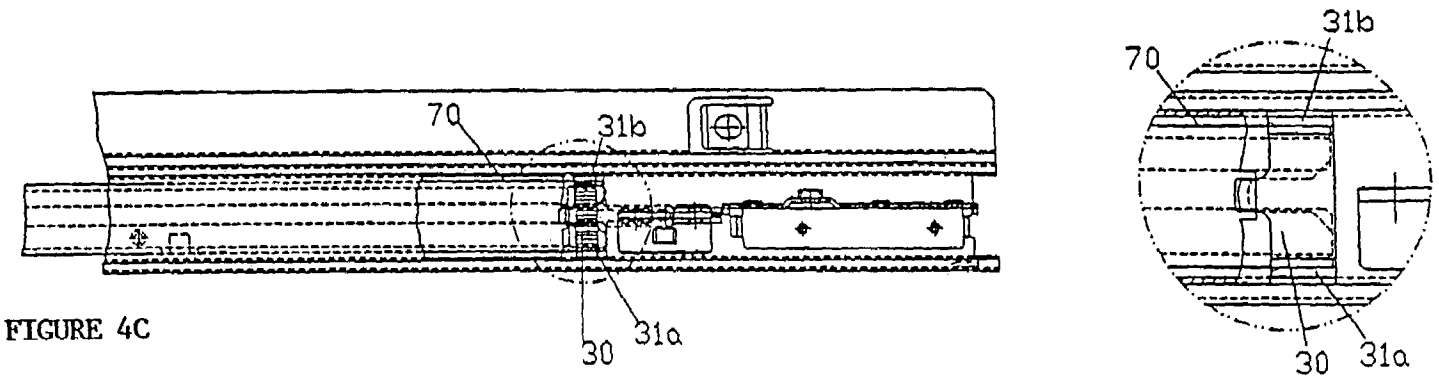

The runner system as shown in FIG. 2G comprises a channel 70, as a pullout guide, having an intermediate pull out rail and a fixed guide. The channel 70 is in the form of an open C-section with unequal sides. On the upper surface on the rear end of the channel 70 is punched and formed an L shape extension, as a backstopper 73. At the forward end of 70 is a recess 71 for engagement with the guide 30 (as shown in FIGS. 4A to 4C. The intermediate pull out rail is in the form of an I-section with horizontal legs being essentially equal in width from either side of the central flange. The fixed guide is similar in construction to the channel 70, and is fixed adjacent to the horizontal flange of an L-section bracket as shown in FIG. 3.

When the runner system assembly is assembled, the intermediate pullout rail is compressed between the channel 70 and the fixed guide. The channel 70 fits slidably over the intermediate pullout rail and both the channel 70 as well as the intermediate pullout rail slides smoothly on rollers (not shown).

Both sides of the drawer are mounted and supported by the runner system 110*a*, 110*b* in order to enable the drawer to be safely drawn in or out, in which the channel 70 will follow the motion of the drawer.

Referring to FIGS. 2C to 2F, the leg 10 is rotatably mounted to the lever 20 by fastening means, for example a rivet 80*a* which extends through the hole 11*a* of leg 10 to hole 23*a* of lever 20. In this connection, the leg 10 is moveable during a released position and locked position, enabling it to raise one end to force the opposite end against the guide means 30. In addition, the leg 10 is provided with a screw slot for fitting in a screwdriver or any suitable tool for rotating the leg 10 in such a manner so as to force the other end down.

When assembled, the lever 20 is connected or attached to the holder 40 by fastening means. In this connection the fastening means include the vertical plate of holder 40 fitting in the slot of the lever 20 and riveted or otherwise screwed, thus providing a pivotal attachment.

The guide 30 however, is mounted relatively on top of the support bracket 60 by means of serration and inserting the L-shaped extension into the slot 61*b* provided on the support bracket 60. The guide 30 is here positioned accordingly, so as to be aligned with the runner system 110*a*, 110*b*. In this position, the guide 30 is able to move sideways or laterally so as to adjust the variance between the respective furniture body and drawer width. The holder 40 supports the lever 20 and is accordingly affixed onto the planar top surface of the support bracket 60, by means of welding. However in this connection, many alternative variations are possible, such as the usage of fastening means including screws or bolts.

Figure 5:
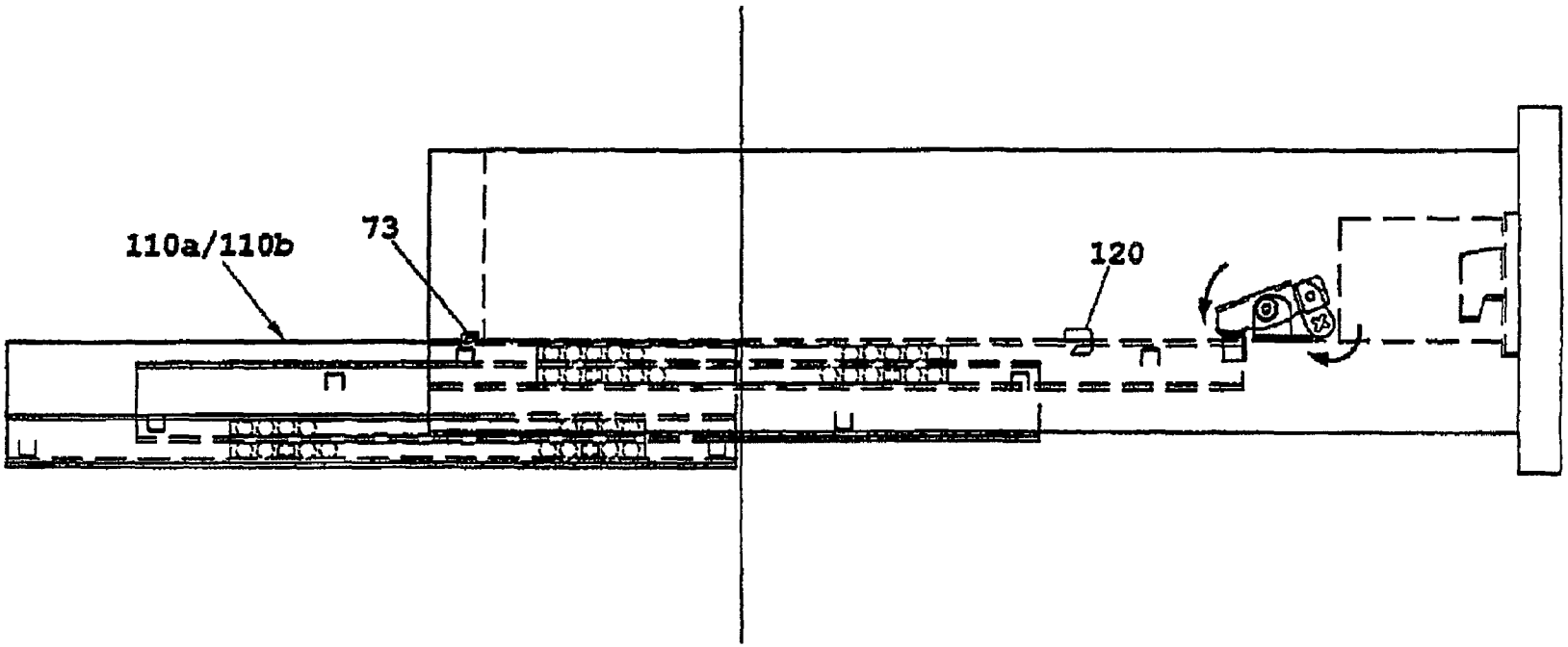
FIG. 5 is a side view of the drawer incorporating the stabilizing arrangement.

A backstopper 73 holds the drawer as well as a clip 120 as shown in FIG. 5. Both backstoppers 73 and clip 120 are adapted to fix the drawer onto the runner system 110*a*, 110*b*.

Figure 6A:
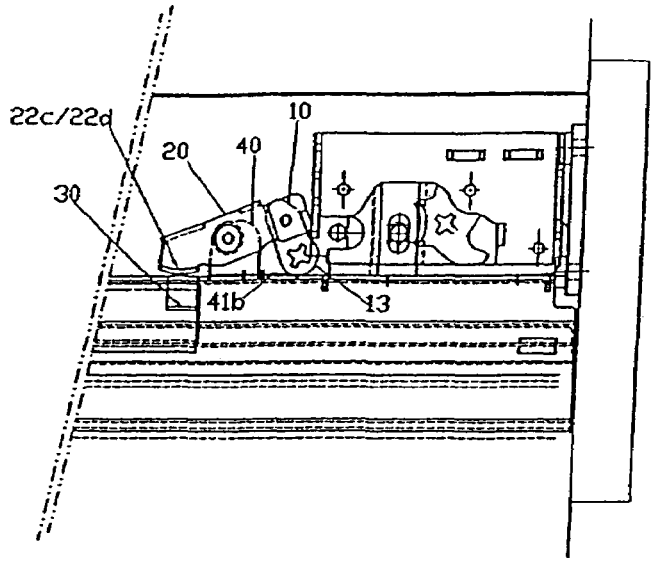
FIGS. 6A to 6C are the side views in partial section the engagement between the top channel of the runner system and guide, according to the present invention.
Figure 6B:
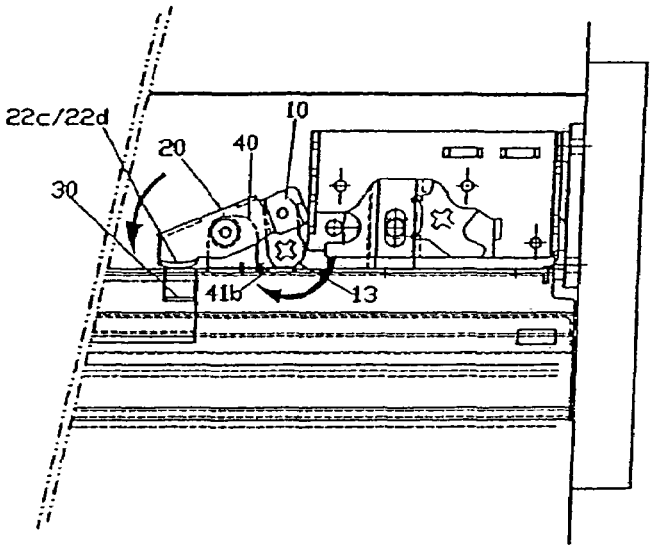
Figure 6C:
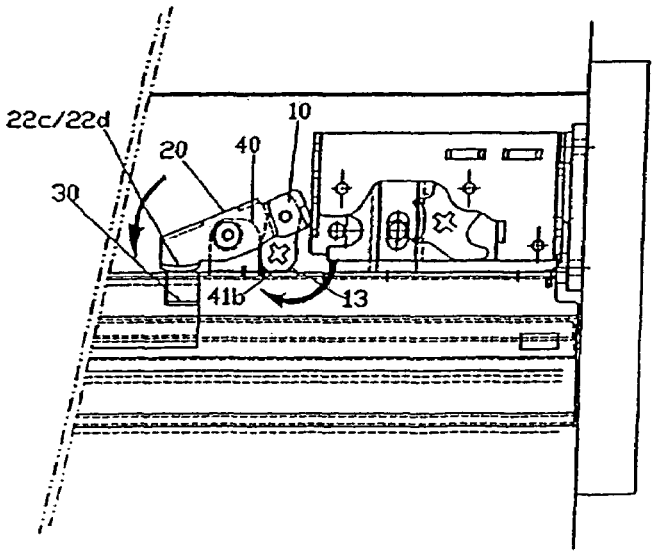

The details of the engagement between the channel 70 and the guide 30 are further described in FIGS. 4A to 4C, followed by the description of the locking mechanism in accordance to FIGS. 6A to 6C of the invention.

Before the engagement of guide 30 and channel 70, the guide 30 is able to move horizontally, which makes it feasible for the drawer to be skewed during a translational movement.

However, as the drawer is pushed for insertion into the furniture body or member, the reaction force exerted during the movement urges the extension of guide 30 which extends downwardly through the slot 61*b* into engagement with the recess 71 provided by the channel 70.

Figure 7:
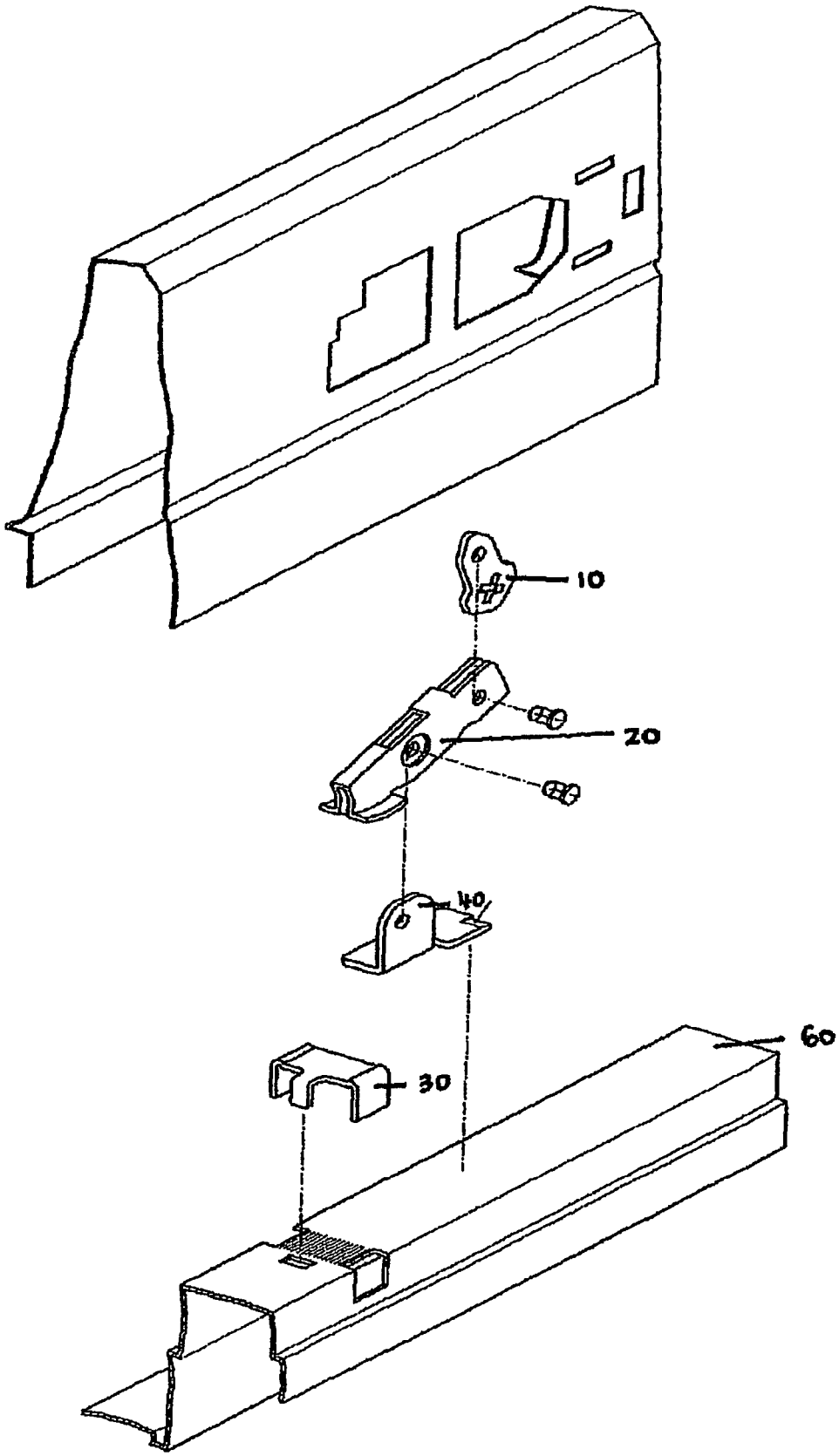
FIG. 7 is a perspective elevational view of the stabilizing arrangement.
Figure 7A:
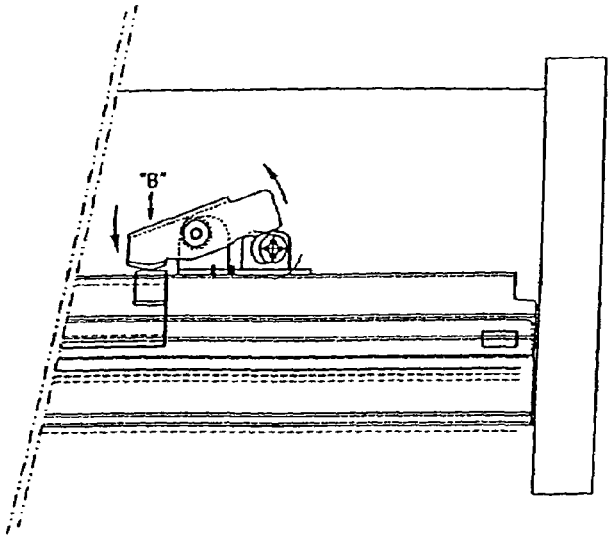
FIGS. 7A to 7C are sectional views on examples of force supplying means.
Figure 7B:
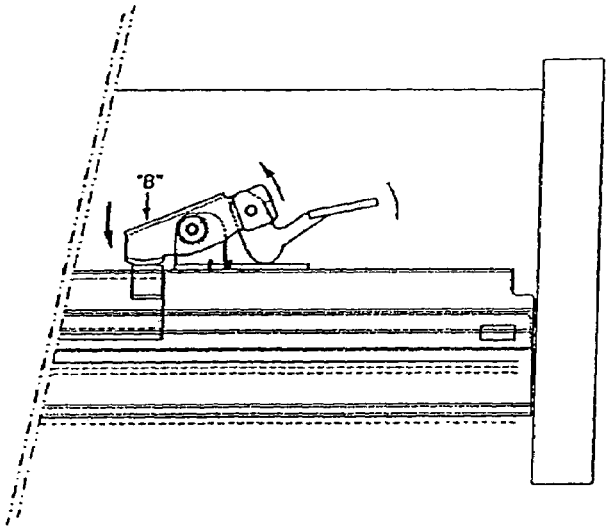
Figure 7C:
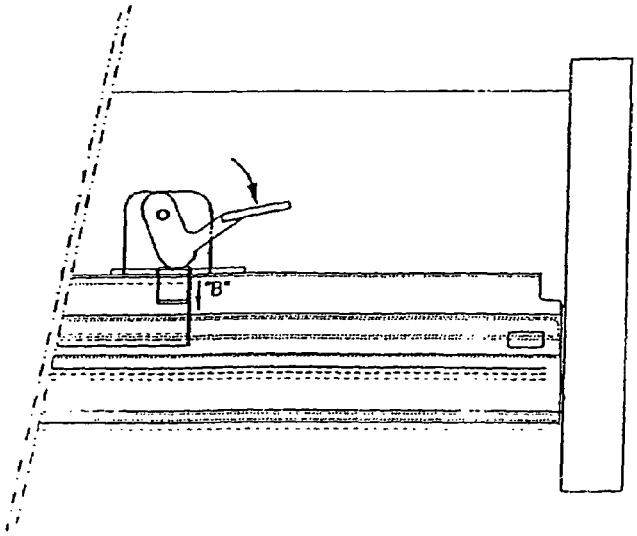
Figure 8:
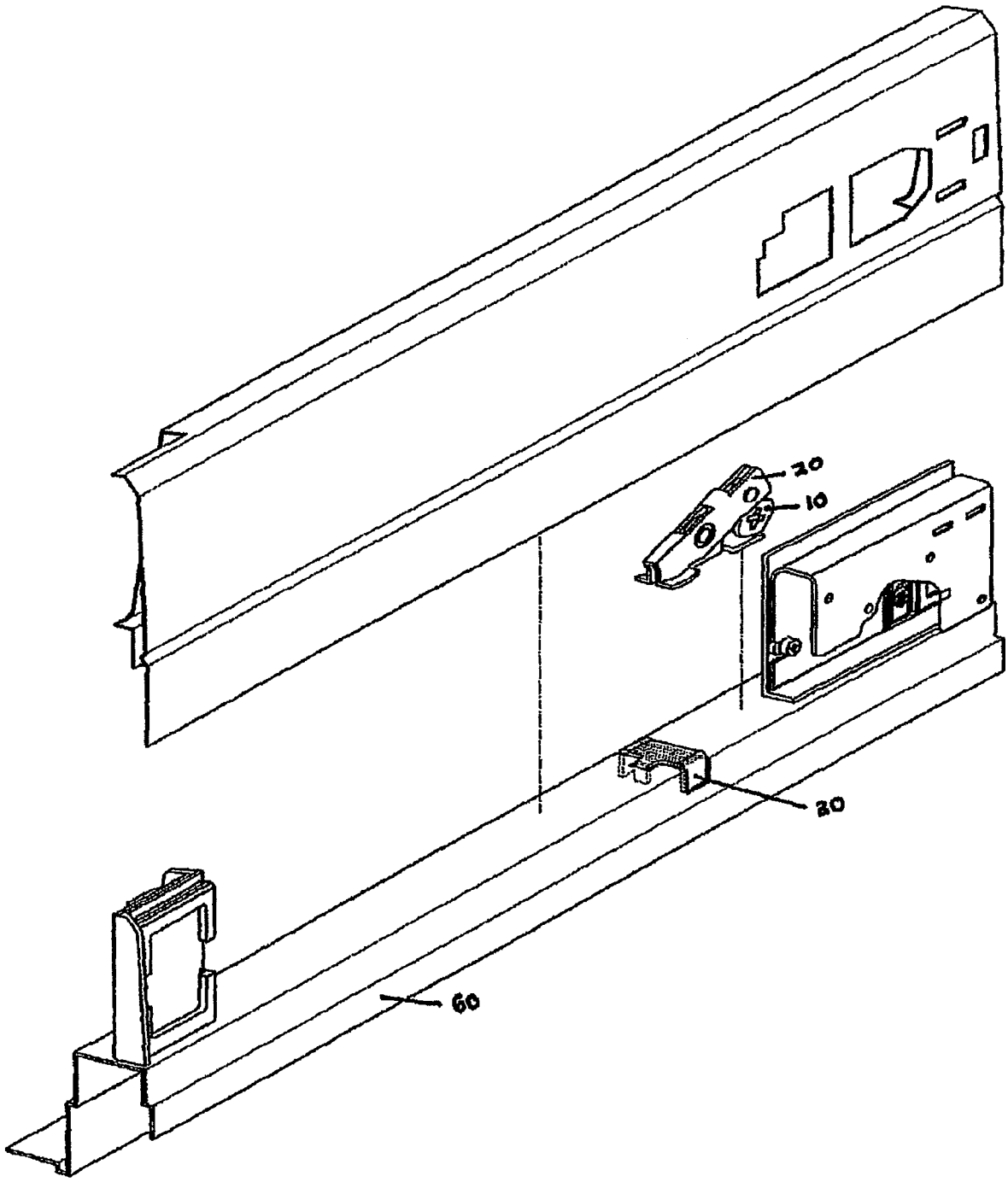
FIG. 8 is a perspective elevational view of the guide 30 and the force supplying means according to the present invention.

The stabilizing arrangement is incorporated on the planar top surface of the bottom support bracket 60, parallel to the direction of the translational movement of the drawer, as shown in FIG. 7 and FIG. 8.

Figure 9:
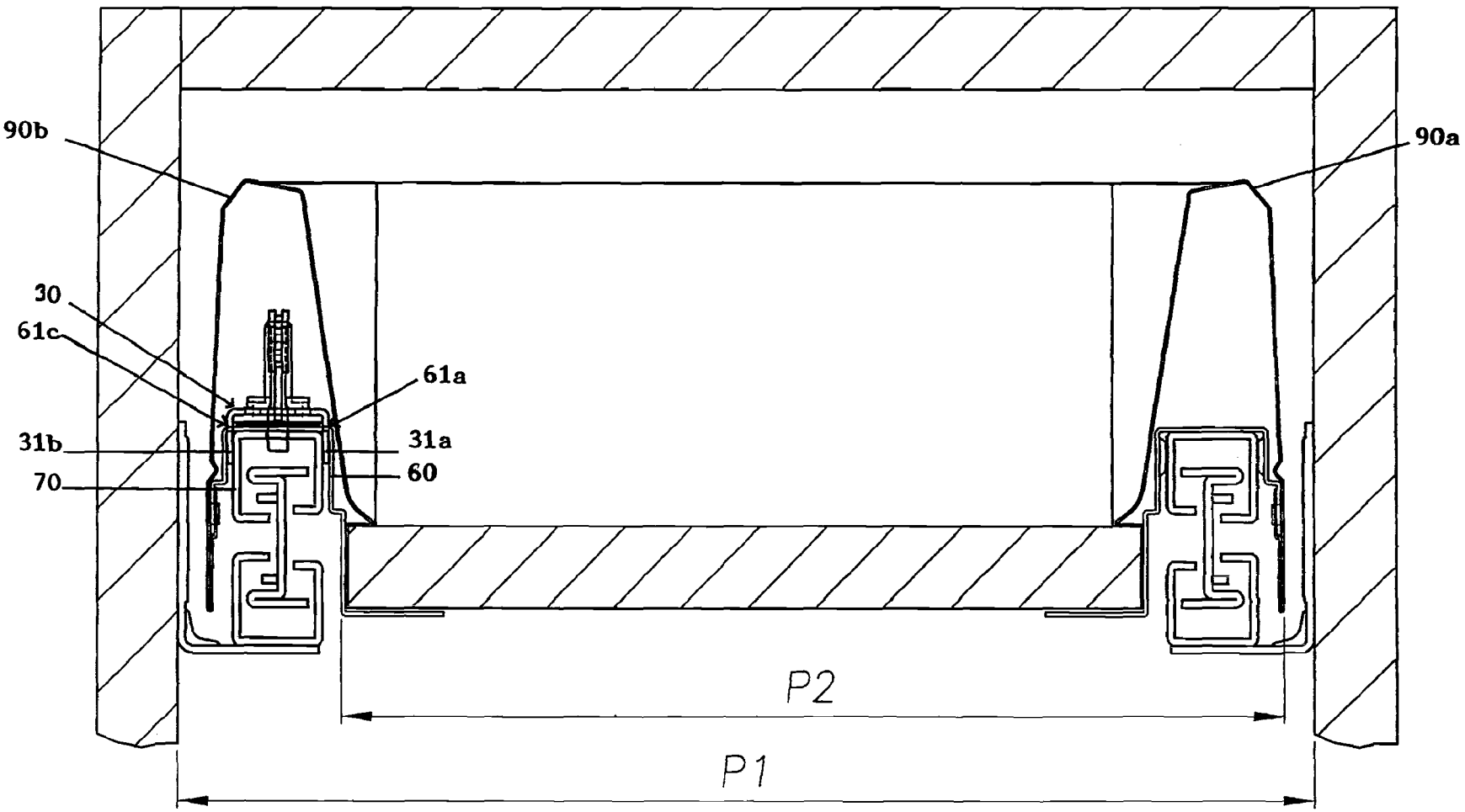
FIG. 9 is a front view of the respective furniture interior width (P1) and the double walled drawer interior width (P2).
Figure 10:
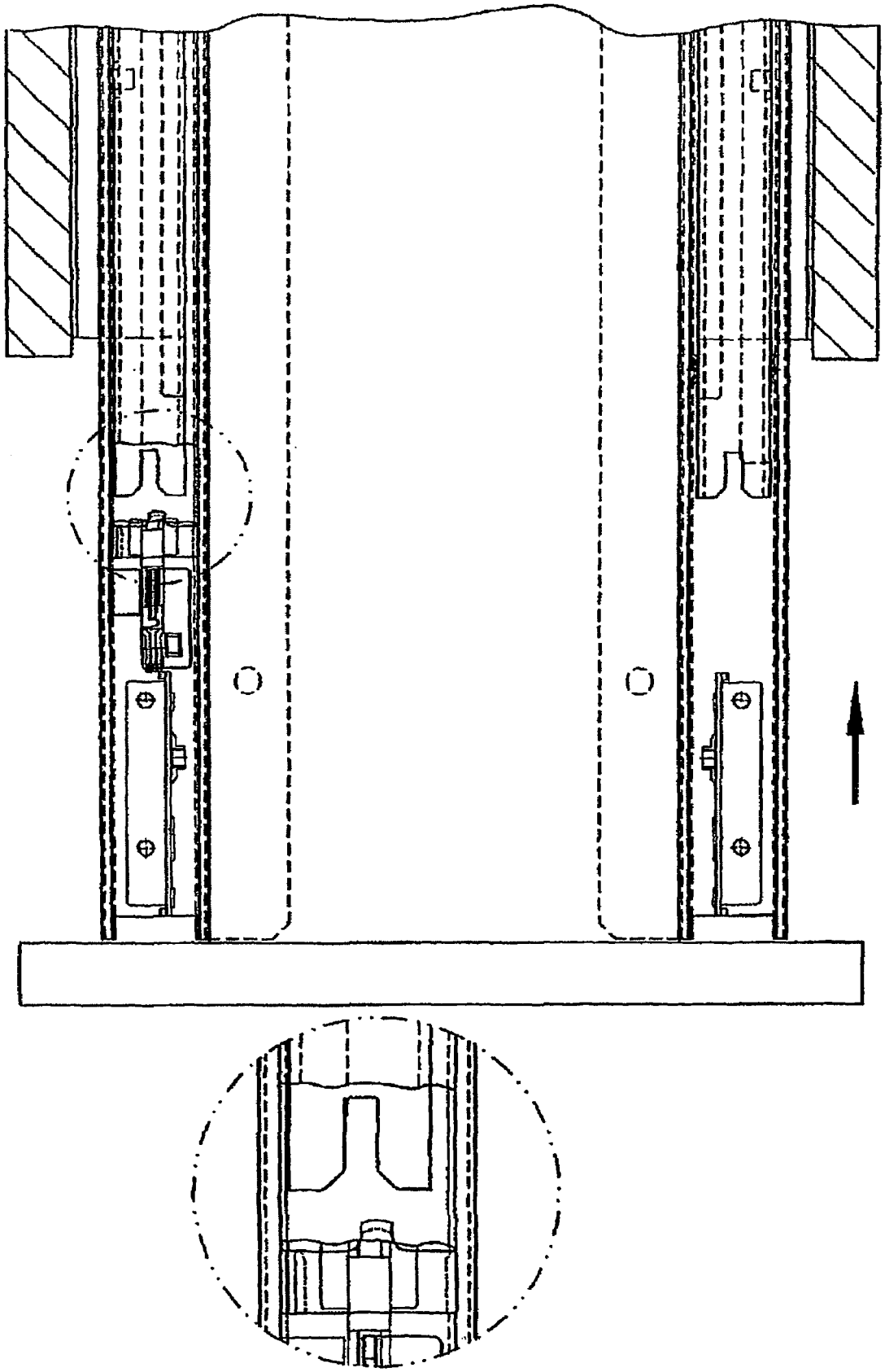
FIG. 10 is a top elevational view of the engagement between the guide and the channel according to the present invention.

When the drawer is pushed for insertion into the furniture body or member, the surface 31*a* together with the surface 31*b* of the guide will assist to conduct the translational movement of the channel 70 externally, while the L-shaped extension which is inserted accordingly into the slot of the support means 60, will come into contact with the angular edge 72*a*, 72*b* provided on the channel 70 and will aid to hold the channel in place and direct the relative translational movement as well. As seen in FIG. 9, channel 70 is held between guide faces 31*a* and 31*b* of guide 30 that project downwardly through recesses 61*a*, 61*c* of the support bracket 60, at each side of channel 70.

As the drawer is pulled out, the guide 30 is pressed down by the extensions 22*c*, 22*d* of the lever 20, as the leg 10 is rotated by inserting a screw driver or any suitable tool into the slot 11*b*. The force acting against the guide 30 in conjunction with lever 20 is exerted by the leg 10, which urges the lever 20 upwardly from the support bracket 60, by simply rotating the leg 10 downwardly, until it reaches a locking point. The engagement of the guide 30 and the serration 62 as well as the interconnection of the guide 30 and channel 70 of the runner system thereby stabilize the movement of the drawer. The reaction force exerted (force B) during the movement urges the extension of guide 30 which extends downwardly through the slot 61*b* into engagement with the recess 71 provided by the channel 70.

Furthermore, the serration 32 on the guide 30 and the serration 62 on the bottom support bracket 60 provide a "lock" between the guide 30 and the bottom support bracket 60. This provides stabilization of the drawer as it undergoes in and out movement, which provides a motion stabilization to defeat any tendency to skew.

In addition, the downward reaction force exerted on the guide 30 as well as the bottom support bracket 60 forcing the serration 62 and serration 32 into engagement with the surface, affords vertical stability by maintaining the stabilization assembly firmly in engagement with the bottom support bracket 60 of the drawer. The locking mechanism is here applied only once so as to maintain the stabilization of the drawer.

It should be mentioned here that alternative ways on how to clamp or force the guide 30 onto the support member so as to lock the stabilized position are shown in FIGS. 7A to 7C.

Accordingly, it can be appreciated that only simple, low cost components are required which nonetheless provide the controlled in and out movement of the drawer.

While this arrangement has been described and illustrated, it is understood that many alternative variations are possible, and could be made to the present invention without departing from the scope of invention.

Reference numeral list:

| | |
|---|---|
| (10) | Lever |
| (11a) | Opening |
| (11b) | Screw driver slot |
| (12) | Face |
| (13) | Smooth edge |
| (20) | Clamp |
| (21) | Recess |
| (22a) | Parallel face-1 |
| (22b) | Parallel face-2 |
| (22c) | Vertical face-1 |
| (22d) | Vertical face-2 |
| (23a) | Opening-1 |
| (23b) | Opening-2 |
| (30) | Guide |

-continued

Reference numeral list:

| | |
|---|---|
| (31a) | Guide face-1 |
| (31b) | Guide face-2 |
| (32) | Serration |
| (33) | Horizontal face |
| (34a) | Locating face-1 |
| (34b) | Front face |
| (34c) | Locating face-2 |
| (40) | Holder |
| (41a) | Vertical face |
| (41b) | Horizontal face |
| (41c) | Tapered edge |
| (42) | Opening |
| (50) | Cover |
| (51) | Opening |
| (60) | Bottom holder |
| (61a) | Recess-1 |
| (61b) | Recess-2 |
| (61c) | Recess-3 |
| (62) | Serration |
| (70) | Top channel |
| (71) | Recess |
| (72a) | Angular edge-1 |
| (72b) | Angular edge-2 |
| (73) | Back stopper |
| (80a) | Rivet-1 |
| (80b) | Rivet-2 |
| (120) | Clip |

What is claimed is:

1. A stabilizing arrangement for a double walled drawer, mounted for guided in and out movement with respect to a furniture body, said arrangement comprising:

drawer support means for supporting said drawer during the in and out movement, said drawer support means having a slot;

a runner system housed within said drawer support means to enable said in and out movement, said runner system including a pull-out guide having a recess;

a guide having an extension engageable within said slot, said guide being locked onto said drawer support means when force is applied and said extension sized such that it is moveable laterally within said drawer support means slot so as to allow variance between the width of said furniture body and said drawer to be accommodated;

said guide extension is secured within said recess through said slot such that the guide is aligned with the runner system, when locked thereto; and wherein the drawer support means is a bottom support bracket and each of the guide and the bottom support bracket further comprises serrations, said serrations being engageable together and provide a lock between the guide and the bottom support bracket when said guide is acted upon by said force.

2. The stabilizing arrangement as claimed in claim 1 further comprising a force supplying means, for locking said guide onto the bottom support bracket.

3. The stabilizing arrangement as claimed in claim 2, wherein the force supplying means applies constant pressure to the guide.

4. The stabilizing arrangement as claimed in claim 2, wherein the force supplying means for locking the guide onto the bottom support bracket includes a lever and a leg.

5. The stabilizing arrangement as claimed in claim 4, wherein said lever is in the form of an inverted U-shaped bracket.

6. The stabilizing arrangement as claimed in claim 4, wherein said leg is formed of sheet metal or any suitable material with two side surfaces with a relatively smooth edge, which is adapted to fit a recess of said lever.

7. The stabilizing arrangement as claimed in claim 2, wherein the force supplying means is affixed onto the bottom support bracket by a holder.

8. The stabilizing arrangement as claimed in claim 7, wherein the holder is in the form of an L-shaped bracket.

9. The stabilizing arrangement as claimed in claim 1, wherein the guide is in alignment automatically with the runner system.

10. A drawer comprising the stabilizing arrangement as claimed in claim 1.

11. The drawer as claimed in claim 10 wherein the stabilizing arrangement is on at least one side of the drawer.

* * * * *